US012060882B2

(12) United States Patent
Cargill

(10) Patent No.: US 12,060,882 B2
(45) Date of Patent: Aug. 13, 2024

(54) ROTARY POSITIVE DISPLACEMENT PUMP

(71) Applicant: ALFA LAVAL CORPORATE AB, Lund (SE)

(72) Inventor: Simon Cargill, Eastbourne (GB)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 17/914,904

(22) PCT Filed: Mar. 26, 2021

(86) PCT No.: PCT/EP2021/057892
§ 371 (c)(1),
(2) Date: Sep. 27, 2022

(87) PCT Pub. No.: WO2021/198060
PCT Pub. Date: Oct. 7, 2021

(65) Prior Publication Data

US 2023/0138342 A1 May 4, 2023

(30) Foreign Application Priority Data

Mar. 31, 2020 (EP) ..... 20167088

(51) Int. Cl.
*F01C 1/18* (2006.01)
*F03C 2/00* (2006.01)
(Continued)

(52) U.S. Cl.
CPC ..... *F04C 2/123* (2013.01); *F04C 2/126* (2013.01); *F04C 15/0026* (2013.01);
(Continued)

(58) Field of Classification Search
CPC ..... F04C 2/123; F04C 2/126; F04C 15/0026; F04C 15/0038; F04C 15/0073;
(Continued)

(56) References Cited

U.S. PATENT DOCUMENTS 4,153,400 A * 5/1979 Morita ..... F04C 15/0038 418/104
4,293,290 A 10/1981 Swanson
(Continued)

FOREIGN PATENT DOCUMENTS

CN 102105691 A 6/2011
CN 203130488 U 8/2013
(Continued)

OTHER PUBLICATIONS

International Search Report (PCT/ISA/210) and Written Opinion (PCT/ISA/237) mailed on May 6, 2021, by the European Patent Office as the International Searching Authority for International Application No. PCT/EP2021/057892. (13 pages).
(Continued)

*Primary Examiner* — Theresa Trieu
(74) *Attorney, Agent, or Firm* — BUCHANAN INGERSOLL & ROONEY PC

(57) ABSTRACT

A rotary positive displacement pump includes a main body rotationally supporting two parallel, axially extending, shafts with gears in constant mesh condition, such that the shafts rotate in opposite directions. A rotor case body is connected to a front side of the main body and has a stationary interior pumping cavity, fluid product inlet and outlet openings, and two cylindrical rotor case hubs each receiving internally one of the shafts. A pair of rotors each have a rotor wing and a rotor drive element that is mounted torque proof on a rotor seat at an end region of one of the shafts. Each rotor seat pair has an axial abutment surface and a mounting surface. The pump also includes fasteners each engaging a mating section of one of the shafts and exerting an axial clamping force on one of the rotor drive elements against one of the axial abutment surfaces.

15 Claims, 7 Drawing Sheets

(51) Int. Cl.

| | |
|---|---|
| ***F03C 4/00*** | (2006.01) |
| ***F04C 2/00*** | (2006.01) |
| ***F04C 2/12*** | (2006.01) |
| ***F04C 15/00*** | (2006.01) |

(52) U.S. Cl.
CPC ..... *F04C 15/0073* (2013.01); *F04C 2230/60* (2013.01); *F04C 2230/604* (2013.01)

(58) Field of Classification Search
CPC ..... F04C 15/0076; F04C 18/126; F04C 2230/60; F04C 2230/604; F04C 2230/70; Y10T 29/49238
See application file for complete search history.

(56) References Cited

U.S. PATENT DOCUMENTS

| | | | | |
|---|---|---|---|---|
| 4,621,994 | A * | 11/1986 | Ellis | F04C 2/123 418/206.1 |
| 5,370,514 | A * | 12/1994 | Morita | F04C 2/123 418/206.1 |
| 5,695,327 | A | 12/1997 | Heinen et al. | |
| 6,328,547 | B1 | 12/2001 | Morita | |
| 7,905,717 | B2 | 3/2011 | Whittome et al. | |
| 8,007,264 | B2 | 8/2011 | Drew et al. | |
| 9,062,676 | B2 | 6/2015 | Garner | |
| 9,273,555 | B2 | 3/2016 | Garner et al. | |
| 2003/0059330 | A1 | 3/2003 | Norman et al. | |
| 2005/0099075 | A1 | 5/2005 | Roslund et al. | |
| 2008/0069707 | A1 | 3/2008 | Norman et al. | |
| 2009/0304540 | A1 | 12/2009 | Whittome et al. | |
| 2012/0328462 | A1* | 12/2012 | Helgeson | F04C 2/123 418/206.1 |
| 2014/0065002 | A1 | 3/2014 | Garner et al. | |
| 2014/0199162 | A1 | 7/2014 | Ramsey et al. | |
| 2015/0064041 | A1 | 3/2015 | Garner | |
| 2015/0118094 | A1 | 4/2015 | Ouwenga et al. | |
| 2015/0139843 | A1 | 5/2015 | Meyer et al. | |
| 2020/0032790 | A1* | 1/2020 | Garner | F04C 15/0038 |

FOREIGN PATENT DOCUMENTS

| | | | |
|---|---|---|---|
| CN | 203348081 | U | 12/2013 |
| CN | 108194353 | A | 6/2018 |
| EP | 0859152 | A2 | 8/1998 |
| EP | 0859153 | A2 | 8/1998 |
| EP | 3 748 166 | A1 | 12/2020 |
| GB | 1 405 955 | A | 9/1975 |
| JP | H0791387 | A | 4/1995 |
| JP | H08284855 | A | 10/1996 |
| KR | 101614274 | B1 | 4/2016 |

OTHER PUBLICATIONS

Office Action (The First Office Action) dated Jun. 8, 2023, by the National Intellectual Property Administration, P. R. China in corresponding Chinese Patent Application No. 202180025638.9 and an English translation of the Office Action. (17 pages).

Office Action (Notification to Grant Patent Right for Invention) issued on Aug. 30, 2023, in corresponding Chinese Patent Application No. 202180025638.9 and English translation of the Office Action. (6 pages).

Office Action/Search Report (Text of Second Office Action) issued on Aug. 10, 2023, in corresponding Chinese Patent Application No. 202180025638.9. and English translation of the Office Action. (11 pages).

* cited by examiner

ROTARY POSITIVE DISPLACEMENT PUMP

TECHNICAL FIELD

The present disclosure relates to rotary positive displacement pump. The disclosure further relates to a method for assembling a rotary positive displacement pump and to a method for providing maintenance to a positive displacement pump.

BACKGROUND

In the field of rotary positive displacement pumps, there is a continuous demand for further improved reliability and reduced maintenance effort.

For example, rotary positive displacement pumps with front loading seals are known and provides simplified maintenance. However, front loading seals may under certain conditions result in reduced long term reliability and pumping efficiency and/or increased manufacturing cost.

There is thus a need for a further improved rotary positive displacement pump in terms of improved reliability, serviceability and pumping efficiency and/or reduced manufacturing cost.

SUMMARY

An object of the present disclosure is to provide a rotary positive displacement pump, a method for assembling a rotary positive displacement pump and a method for providing maintenance to a positive displacement pump, where the previously mentioned problems are avoided. This object is at least partly achieved by the features of the independent claims.

In particular, according to a first aspect of the present disclosure, there is provided a rotary positive displacement pump for pumping a fluid product. The pump has a front side and a rear side and comprises a main body providing rotational support to a pair of parallel, axially extending, shafts with gears in constant mesh condition, such that the pair of shafts are arranged to rotate in opposite directions. The pump further comprises a rotor case body connected to a front side of the main body, wherein the rotor case body has a stationary interior pumping cavity defined by an axial rear wall, a circumferential side wall, and a removable front cover, a fluid product inlet opening, a fluid product outlet opening, and a pair of cylindrical rotor case hubs extending from the rear wall, wherein each cylindrical rotor case hub receives internally one of the pair of shafts. The further comprises a pair of rotors, each having at least one rotor wing and a rotor drive element that is mounted torque proof on a rotor seat at an end region of one of the pair of shafts, wherein each of the pair of rotor seats has an axial abutment surface facing in an axial direction towards a front side of the pump and a mounting surface facing radially outwards. The pump further comprises a pair of fasteners, preferably threaded fasteners, each being engaged with a mating section, preferably a threaded section, at the end region of one of the pair of shafts, and each exerting an axial clamping force on one of the rotor drive elements against the axial abutment surface of one of the rotor seats, wherein the axial abutment surface of each rotor seat is located axially outside, towards a front side, of the associated hub.

Moreover, according to a second aspect of the present disclosure, there is provided a method for assembling a rotary positive displacement pump for pumping a fluid product, the pump having a front side and a rear side. The method comprises providing a main body giving rotational support to a pair of parallel, axially extending, shafts with gears in constant mesh condition, such that the pair of shafts are arranged to rotate in opposite directions. The method further comprises providing a rotor case body having: a stationary interior pumping cavity defined by an axial rear wall, a circumferential side wall, and a removable front cover; a fluid product inlet opening; a fluid product outlet opening; and a pair of cylindrical rotor case hubs extending from the rear wall, wherein the rotor case body is located on a front side of the main body, and wherein each cylindrical rotor case hub receives internally one of the pair of shafts. The method additionally comprises providing a pair of rotors, each having at least one rotor wing and a rotor drive element. Moreover, the method comprises mounting each rotor drive element torque proof on a rotor seat at an end region of one of the pair of shafts, wherein each rotor seat has an axial abutment surface facing in an axial direction towards a front side of the pump and mounting surface facing radially outwards, and mounting a fastener, preferably a threaded fastener, on an end region of each of the pair of shafts. Finally, the method comprises tightening the fasteners for exerting an axial clamping force on each rotor drive element against the axial abutment surface of one of the rotor seats, wherein the axial abutment surface of each rotor seat is located axially outside, towards a front side, of the associated hub, and mounting the removable front cover on the rotor case body.

In addition, according to a third aspect of the present disclosure, there is provided a method for assembling a rotary positive displacement pump having a front side and a rear side. The method comprises providing a pump having two parallel axially extending shafts, an interior pumping cavity and a pair of cylindrical rotor case hubs extending towards the front side from a rear wall of the interior pumping cavity, and providing a pair of rotors, each having at least one rotor wing connected to a central rotor drive element. The method further comprises mounting a first part of a first pair of seal assemblies, such as mechanical face-seal assemblies, in a front seal seat of each cylindrical rotor case hub, and mounting a second part of the first pair of seal assemblies, such as mechanical face-seal assemblies, in a rotor seal seat of each rotor drive element. The method additionally comprises mounting one of the pair of rotors on each shaft, wherein each shaft has a rotor seat with an axial abutment surface facing in an axial direction towards a front side of the pump. Finally, the method comprises abutting each rotor drive element against the axial abutment surface of an associated rotor seat, wherein the axial abutment surface of each rotor seat is located axially outside, towards a front side, of the associated hub, and thereafter mounting a removable front cover on the pump.

In addition, according to a fourth aspect of the present disclosure, there is provided a method for providing maintenance to a sealing arrangement of a rotary positive displacement pump. The pump has a front side and a rear side and two parallel axially extending shafts, wherein each shaft is carrying a rotor having at least one rotor wing and a rotor drive element. The pump further has an interior pumping cavity including a pair of cylindrical rotor case hubs extending towards the front side from a rear wall of the interior pumping cavity, wherein each shaft has a rotor seat with an axial abutment surface facing in an axial direction towards a front side of the pump. The method comprises: removing a removable front cover of the pump, removing at least one of the pair of rotors from the associated shaft for enabling access to a sealing arrangement configured for preventing leakage along a gap between the associated shaft and the associated cylindrical rotor case hub, servicing the sealing arrangement, mounting the at least one removed rotor on the associated shaft and abutting the rotor drive element against the axial abutment surface of an associated rotor seat, wherein the axial abutment surface of each rotor seat is located axially outside, towards a front side, of the associated hub, and mounting the removable front cover on the pump.

The rotary positive displacement pump and associated method of assembly described above not only enables reduced maintenance effort by means of the front loading seals, due to the design wherein the axial abutment surface of each rotor seat is located axially outside, towards a front side, of the associated hub, the rotary positive displacement pump and associated method of assembly described above additionally enable increased dimension of the first and second shafts without negative effect on pumping volume or exterior pump dimensions.

In particular, increased dimension of the first and second shaft, i.e. increased diameter, has positive effects in many ways. For example, the increased dimension results in increased shaft stiffness. As a result, the shafts, rotors and/or rotor case body may be manufactured in less exotic materials without sacrificing operating reliability or risk for material fatigue. For example, conventional stainless steel, such as duplex stainless steel, may be used to a larger degree. In addition, thanks to the stiffer first and second shafts, the clearance between the rotor wings and the radial and axial walls of the stationary pumping cavity may be reduced, thereby resulting in reduced pump slippage and increased pumping efficiency.

Further advantages are achieved by implementing one or several of the features of the dependent claims.

In some example embodiments, a mounting portion of each rotor drive element is radially non-overlapping the associated cylindrical rotor case hub. Thereby, space for increased shaft diameter may be accomplished.

In some example embodiments, a mounting portion of each rotor drive element includes an axial abutment surface facing in an axial direction towards a rear side of the pump and a mounting surface facing radially inwards, and the axial abutment surface of each mounting portion is located axially outside, towards a front side, of the associated hub. Thereby, space for increased shaft diameter may be accomplished.

In some example embodiments, the mounting portion of each rotor drive element does not extend radially outside of an inner diameter of the associated cylindrical rotor case hub.

In some example embodiments, the torque proof connection between each of the rotor drive elements and the associated shaft is a splined or keyed connection.

Thereby, a robust and reliable torque connection is accomplished.

In some example embodiments, each rotor drive element comprises an annular projection extending towards the rear side of the pump, wherein the annular projection comprises the axial abutment surface, and wherein each annular projection is arranged on a portion of the associated shaft.

In some example embodiments, the pump further comprises a first pair of seal assemblies, such as mechanical face-seal assemblies, each having a first part and a second part with sealing surfaces pressed against each other, and each arranged to prevent fluid product from escaping the stationary pumping cavity and flowing along one of the shafts towards the rear side of the rotor case body. Thereby, a leakage-proof pump is accomplished.

In some example embodiments, each cylindrical rotor case hub has a front seal seat facing towards the front side of the pump, wherein the front seal seat is located at a front region of each rotor case hub, and wherein each front seal seat has the first part of one of the first pair of seal assemblies mounted therein. Thereby, front-loading of the seal is enabled.

In some example embodiments, the first part of each first pair of seal assemblies faces, as seen in the radial direction, a circumferential outer surface of a portion of the associated shaft. Thereby, a compact pump design with large diameter shafts is accomplished.

In some example embodiments, each rotor drive element has a rotor seal seat facing towards the rear side of the pump, wherein each rotor seal seat has the second part of one of the first pair of seal assemblies mounted therein. Thereby, the seals are easily accessible from the front side of the pump.

In some example embodiments, the rotary positive displacement pump is configured for front-loading of the first pair of seal assemblies. Thereby, improved serviceability is accomplished.

In some example embodiments, an exterior diameter of each shaft in an axial region of the front seal seat of each cylindrical rotor case hub is larger than an exterior diameter of each shaft in an axial region of, and in contact with, the mounting portion of each rotor drive element. Thereby, large diameter shafts are accomplished over a wider range.

In some example embodiments, the pump further comprises a second pair of seal assemblies, such as mechanical face-seal assemblies, each having a first part and a second part with sealing surfaces pressed against each other, and each arranged to prevent fluid product from flowing along the shaft towards the rear side of the rotor case body. Thereby, the sealing performance is further improved.

In some example embodiments, the method further comprising an intermediate step, performed before mounting the rotor drive elements to the shafts, of mounting a first part of a first pair of seal assemblies, such as mechanical face-seal assemblies, in a front seal seat of each cylindrical rotor case hub, and mounting a second part of the first pair of seal assemblies, such as mechanical face-seal assemblies, in a rotor seal seat of each rotor drive element.

The pump according to the disclosure can be arranged for pumping a variety of different product fluids, in particular product fluids commonly known in dairy, food, beverage, pharma and personal care markets.

In some example embodiments, the rotary positive displacement pump is a circumferential piston pump or a lobe pump. Preferably, the rotary positive displacement pump is a circumferential piston pump.

Further features and advantages of the invention will become apparent when studying the appended claims and the following description. The skilled person in the art realizes that different features of the present disclosure may be combined to create embodiments other than those explicitly described hereinabove and below, without departing from the scope of the present disclosure.

BRIEF DESCRIPTION OF DRAWINGS

The disclosure will be described in detail in the following, with reference to the attached drawings, in which.

DESCRIPTION OF EXAMPLE EMBODIMENTS

Various aspects of the disclosure will hereinafter be described in conjunction with the appended drawings to illustrate and not to limit the disclosure, wherein like designations denote like elements, and variations of the described aspects are not restricted to the specifically shown embodiments, but are applicable on other variations of the disclosure.

Figure 1:
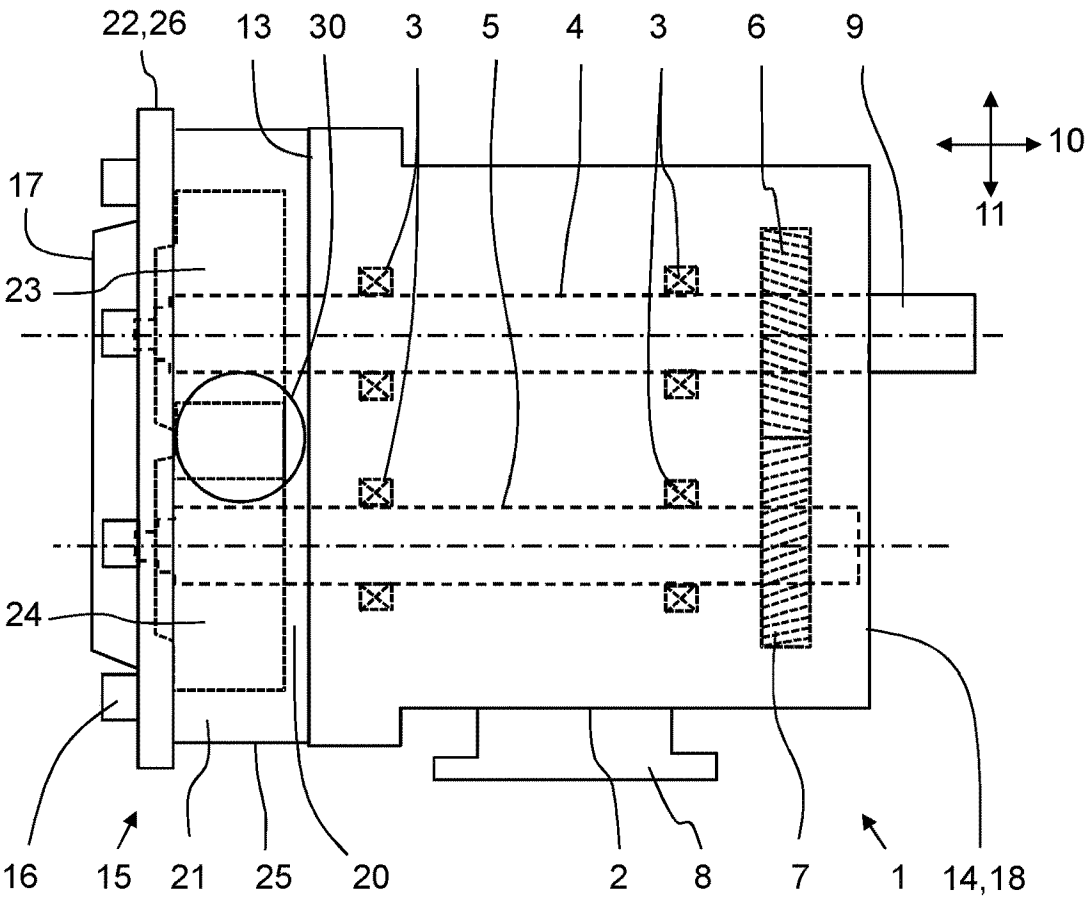
FIG. 1 shows schematically a side of a pump according to the disclosure.

FIG. 1 schematically shows a side view of a first example embodiment of the rotary positive displacement pump 1 for pumping a fluid product according to the disclosure. The pump 1 has a main body 2 including rotational support 3 to first and second parallel shafts 4, 5, which extend in an axial direction 10. The rotational support 3 may for example be provided in form of a set of annular rolling bearings, each of which surrounds a shaft and is fastened to the main body 2. The first axially extending shaft 4 carries a first gear 6 and the second axially extending shaft 5 carries a second gear 7. The first and second gears 6, 7, i.e. gear wheels, are arranged in constant mesh condition, meaning that they are in constant gear engagement with each other. Moreover, since the first and second gears 6, 7 are in directing engagement with each other they rotate in opposite directions.

The main body 2 has an axial direction 10, a first lateral direction 11 that is perpendicular to the axial direction 10, and a second lateral direction 12 that is perpendicular to both the axial direction 10 and the first lateral direction 11. The main body further has a front side 13 and a rear side 14, as seen in the axial direction 10.

An end portion 9 of one of the first and second shafts 4, 5, such as for example the first shaft 4, may extend out through a wall of the main body 2 in the rear side of the main body 2 for rotational connection with a rotational torque source, such as for example a motor, for powering the pump 1.

The main body 2 may be made of metal, such as for example cast iron, steel or aluminium alloy, and the first and second shafts 4, 5 may be made of steel.

The main body 2 may additionally include a support structure 8 for enabling attachment of the main body to an exterior support surface, for example by means of threaded bolts or other type of fasteners. The main body may be made in one piece or composed of multiple sub-parts.

In the example embodiment of the pump illustrated in FIG. 1, the pump 1 further comprises a rotor case body 15 connected to the main body 2 at the front side 13 of the main body 2. The rotor case body 15, which for example is made of stainless steel, may be removably fastened to the front side 13 of the main body 2 via a suitably fastening arrangement. For example, the rotor case body 15 may be clamped against the front side 13 of the main body 2 by means of a plurality of threaded bolts or nuts 16 or similar threaded members. Alternatively, the rotor case body 15 may be permanently attached to the front side 13 of the main body 2, of integrally formed within the main body 2.

Figure 2:
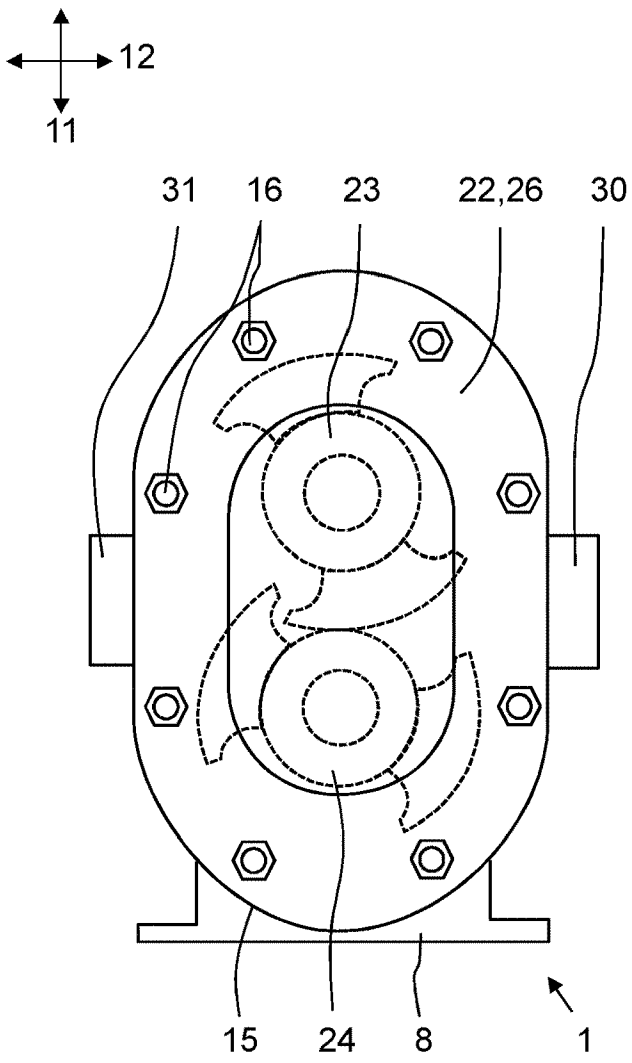
FIG. 2 shows schematically a front view of the pump according to the disclosure.

The assembled pump 1 including the main body 2 and the rotor case body 15 has a front side 17 and a rear side 18, and the pump 1 of FIG. 1 is shown from a front side in FIG. 2. As can be seen in FIG. 2, the plurality of threaded bolts or nuts 16 used for clamping the rotor case body 15 may extending through the entire rotor case body 15 and by visible from the front side 17 of the pump 1.

In the example embodiment of FIGS. 1 and 2, the rotor case body 15 comprises an axial rear wall 20, a circumferential side wall 21 and an axial front wall 22, which jointly defines a closed stationary interior pumping cavity.

Since the rotor case body 15 includes first and second rotors 23, 24 located within the interior pumping cavity, the rotor case body 15 is openable for enabling access to the interior pumping cavity. In the example embodiment of FIGS. 1 and 2, this access is made possible by making the rotor case body 15 in two parts: a rotor case rear housing 25 including the axial rear wall 20 and circumferential side wall 21 of the rotor case body 15, and a front cover 26 including the axial front wall 22 of the rotor case body 15, wherein the removable front cover 26 is removably fastened to the rotor case rear housing 25 by suitable attachment arrangement.

Figure 3:
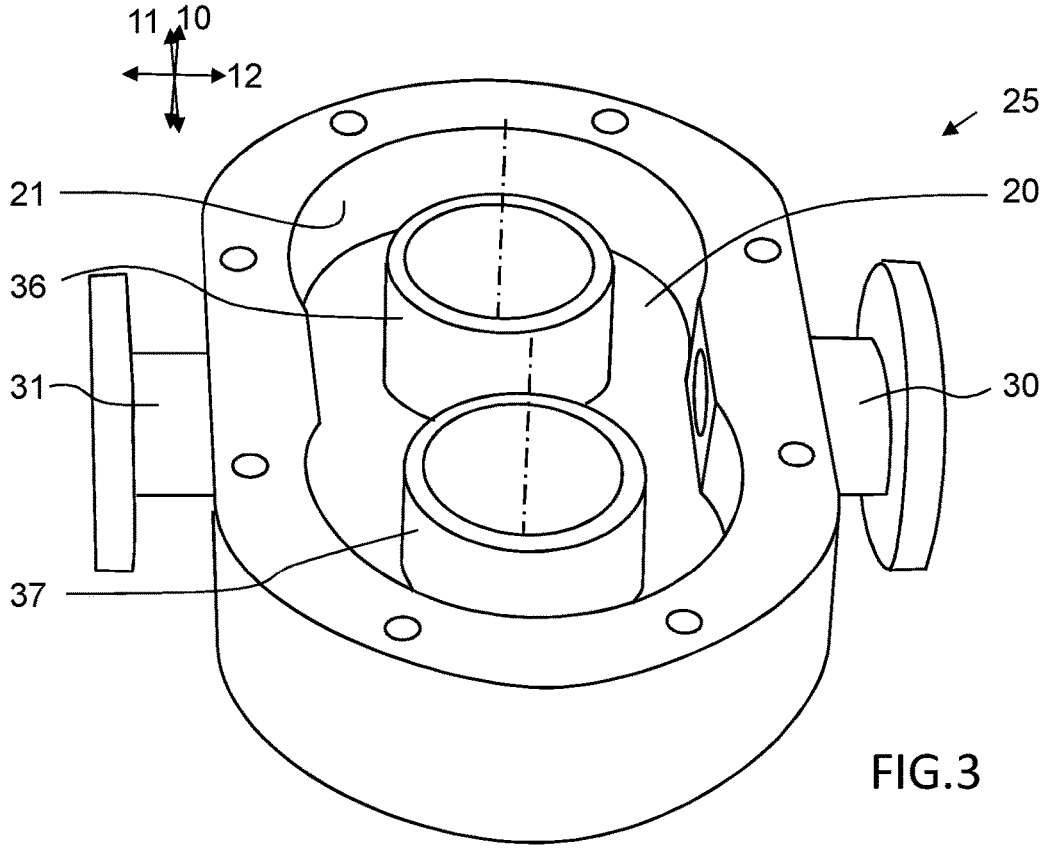
FIG. 3 shows schematically a 3D view of an example embodiment of the rotor case hub.

A schematic 3D view of an example embodiment of a rotor case rear housing 25 according to the disclosure is provided in FIG. 3, as seen partly from a front side of the rotor case rear housing 25.

The removable front cover 26 may be clamped against the rotor case rear housing 25 by means of the same plurality of threaded bolts or nuts 16 that are used for clamping the rotor case body 15 against the front side 13 of the main body 2. Alternatively, separate attachment arrangements may be provided for attaching the front cover 26 to the rotor case rear housing 25.

In the example embodiment of FIGS. 13, the rotor case body 15 further includes a fluid product inlet opening 30 for enabling a fluid product to enter, e.g. being sucked into, the interior pumping cavity, and a fluid product outlet opening 31 for enabling the fluid product to exit, e.g. being pumped out of, the interior pumping cavity.

As mention above, the rotor case body 15 furthermore includes the first and second rotors that are configured for generating the pumping functionality of the pump. The first rotor 23 is rotationally fastened to a front end of the first shaft 4 and the second rotor 24 is rotationally fastened to a front end of the second shaft 5. Consequently, the first and second rotors 23, 24 are configured to rotate in mutually opposite directions, as illustrated by solid arrows in FIG. 5.

Figure 4:
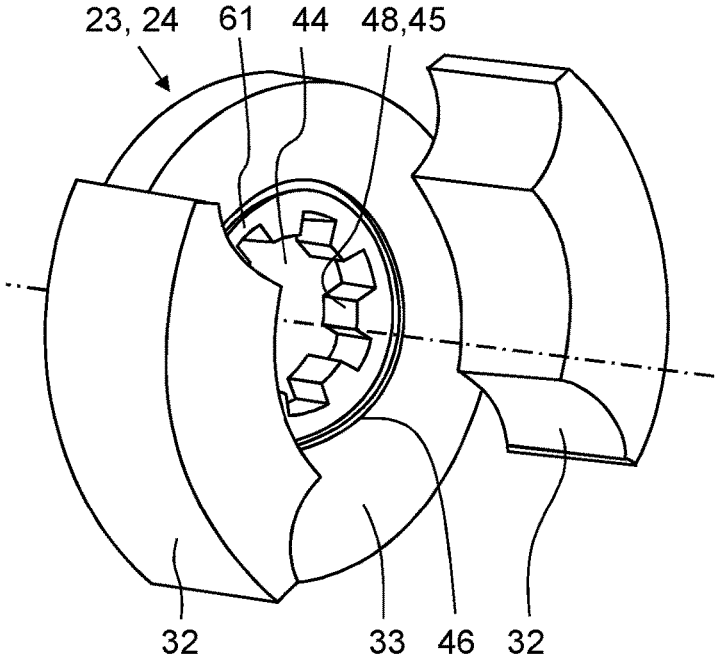
FIG. 4 shows schematically a 3D view of an example embodiment of a rotor.
Figure 4:
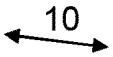

The first and second rotors 23, 24, which may have substantially identical design, are schematically illustrated in FIGS. 1 and 2, and a 3D view of a rotor, as seen partly from a rear side, is provided in FIG. 4. Each of the first and second rotors 23, 24 has at least one, and preferably a plurality of, rotor wings 32 and a rotor drive element 33 that is configured to be mounted torque proof on a rotor seat of an associated shaft 4, 5. In particular, the rotor seat is located at a front end region of each shaft 4, 5.

The rotor drive element 33 of each rotor 23, 24 may be substantially disc-shaped or sleeve-shaped and including a central hole or recess 44 for mounting on the associated shaft 4, 5. The hole or recess 44 may be defined by a cylindrical mounting surface 48 having splines 45, or by a non-circular mounting surface for enabling torque proof mounting of the rotor on the rotor seat of the associated shaft 4, 5. The rotor drive element 33 of each rotor 23, 24 may additionally include an annular rotor seal seat 46 facing towards the rear side 18 of the pump 1 and configured for housing a seal. The annular rotor seal seat 46 may for example be implemented in form of a groove machined or otherwise manufactured in a rearwards facing surface of the rotor drive element 33 of each rotor 23, 24.

Figure 5:
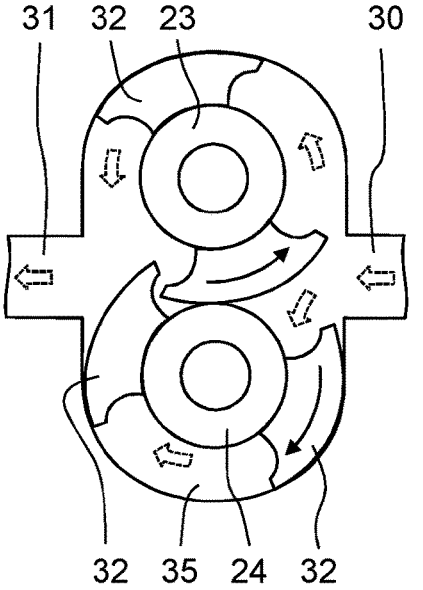
FIG. 5 shows schematically the functionality of the pump.
Figure 5:
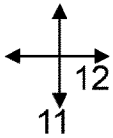

With reference to FIG. 5, in this example embodiment of the pump 1, during operation of the pump 2, the rotors are configured to rotate in opposite directions with the same rotational speed. The rotors are configured to define a pumping volume within a space 35 restricted by the neighbouring rotor wings of the same rotor and the walls 20, 21, 22 of the interior pumping cavity. Moreover, during rotation of the rotors 23, 24, the fluid product is configured to be conveyed from the fluid product inlet opening 30, along an outer side of each rotor 23, 24 and to the fluid product outlet opening 32, illustrated by the dashed arrows in FIG. 5.

In particular, when the rotor wings (pistons) rotate around the circumference of the pumping cavity, this continuously generates a partial vacuum at the product inlet opening as the rotors unmesh, causing product fluid to enter the pump. The fluid is transported around the pumping cavity by the rotor wings, and is displaced as the rotor wings re-mesh, generating pressure at the discharge port. Direction of flow is reversible.

The specific form and number of rotor wings 32 may vary considerably and the specific rotor twin-wing design illustrated in FIGS. 2, 4 and 5 is merely one example embodiment of rotor wings, and the pump may thus have rotors 23, 24 with other types of rotor wing designs according to the disclosure.

With reference to FIG. 3, the rotor case body 15 comprises a first cylindrical rotor case hub 36 extending from the rear wall 20, and second cylindrical rotor case hub 37 extending from the rear wall 20. The first and second hubs 36, 37 are essentially hollow cylindrical sleeves that are open towards both axial sides thereof. Moreover, an axial direction of each cylindrical hubs is aligned with the axial direction of the pump 1.

The first rotor case hub 36 is configured to receive the first shaft 4, and the second rotor case hub 37 is configured to receive the second shaft 5. In other words, in an assembled state, the first rotor case hub 36 is aligned with the first shaft 4, and the second rotor case hub 37 is aligned with the second shaft 5. The first and second hubs 36, 37 are thus displaced from each other in the first lateral direction 11.

Prior to assembly of the main body 2 with the rotor case body 15, the front ends of the first and second shafts 4, 5 protrude forwards beyond the front surface 13 of the main body. Subsequently, upon assembly of the main body 2 with the rotor case body 15, said front ends of the first and second shafts 4, 5 are inserted from a rear side into the first and seconds hubs, respectively, and a rear side of the rotor case body 15 comes into contact with the front surface 13 of the main body 2. In this state, the front ends of the first and second shafts 4, 5 extend through the complete axial length of the first and seconds hubs 36, 37, as schematically shown in FIG. 6.

Figure 6:
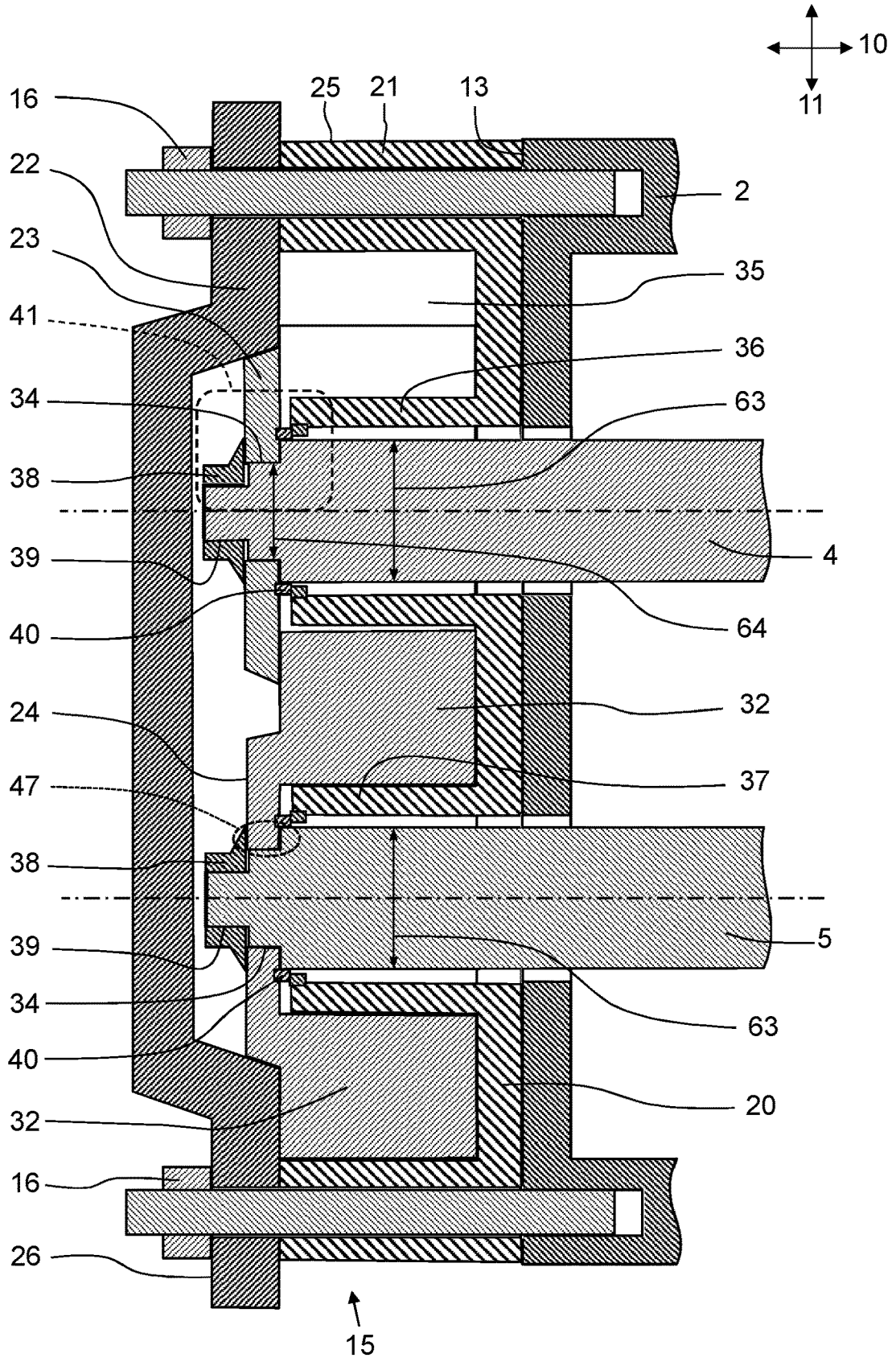
FIG. 6 shows schematically a cross-section of a front portion of an example embodiment of the pump.

More in detail, FIG. 6 shows a cross-sectional side view of a front portion of an example embodiment of the pump 1 in an assembled state including a front portion of the main body 2, the rotor case body 15 composed of the rotor case rear housing 25 and the front cover 26, threaded fasteners 16 for clamping the rotor case body 15 against the front surface 13 of the main body 2, and first and second rotors 23, 24 being mounted torque proof on the rotor seats 34 of the first and second shafts 4, 5, respectively.

FIG. 6 also shows a space 35 that is restricted by the neighbouring rotor wings of the same rotor, the axial rear wall 20, the circumferential side wall 21, the axial front wall 22, and the first rotor case hub 36. Clearly, although not showed in FIG. 6, also the second rotor 24 defines spaces 35 between neighbouring rotor wings 32 of the same rotor 24.

In addition, FIG. 6 also shows that each of the first and second rotors 23, 24 are secured to the rotor seats 34 of the associated shaft 4, 5 by means of a fastener 38, preferably a threaded fastener, that is engaged with a mating section 39, preferably a mating threaded section, at an end region of the associated shaft 4, 5. Specifically, each of said fastener 38 is configured to exert an axial clamping force on a centre portion of the associated rotor 23, 24 for clamping the rotor 23, 24 against an axial abutment surface of the rotor seat of the shaft 4, 5.

FIG. 6 further shows that each of the first and second rotor case hubs 36, 37 is provided with a annular sealing arrangement 40 for preventing fluid product located within the space 35 from leaking out along the first and second shafts 4, 5 towards the rear side of the rotor case body.

Each annular sealing arrangement 40 may for example be implemented in form of a seal assembly having two main sealing parts. A first annular sealing part is associated with the rotor case hub and a second annular sealing part is associated with the rotor. Preferably, the seal assembly is a mechanical face-seal assembly. Then, the first and second sealing parts are held in sealing contact against each other in the axial direction while allowing relative rotation. One or both of the first and/or second annular sealing parts may have square-shaped, L-shaped, I-shaped or P-shaped cross-sectional shape, or any other shape, as seen in a plane extending through a centre of the annular sealing arrangement 40 and aligned with the axial direction 10.

In general, mechanical face seal technology involves having one seal ring remaining stationary as a shaft with a corresponding mating seal ring rotates. Thus, a dynamic seal is established between the contact faces of the seal ring and mating seal ring. However, the sealing arrangement 40 may be implemented using other types of seals. For example, an elastic seal, such as an o-ring or lip seal, may be associated with the rotor case or rotor case hub thereof and a sleeve may be associated with the rotor. Optionally, the elastic seal may be mounted on a housing associated with the rotor case hub.

Figure 7:
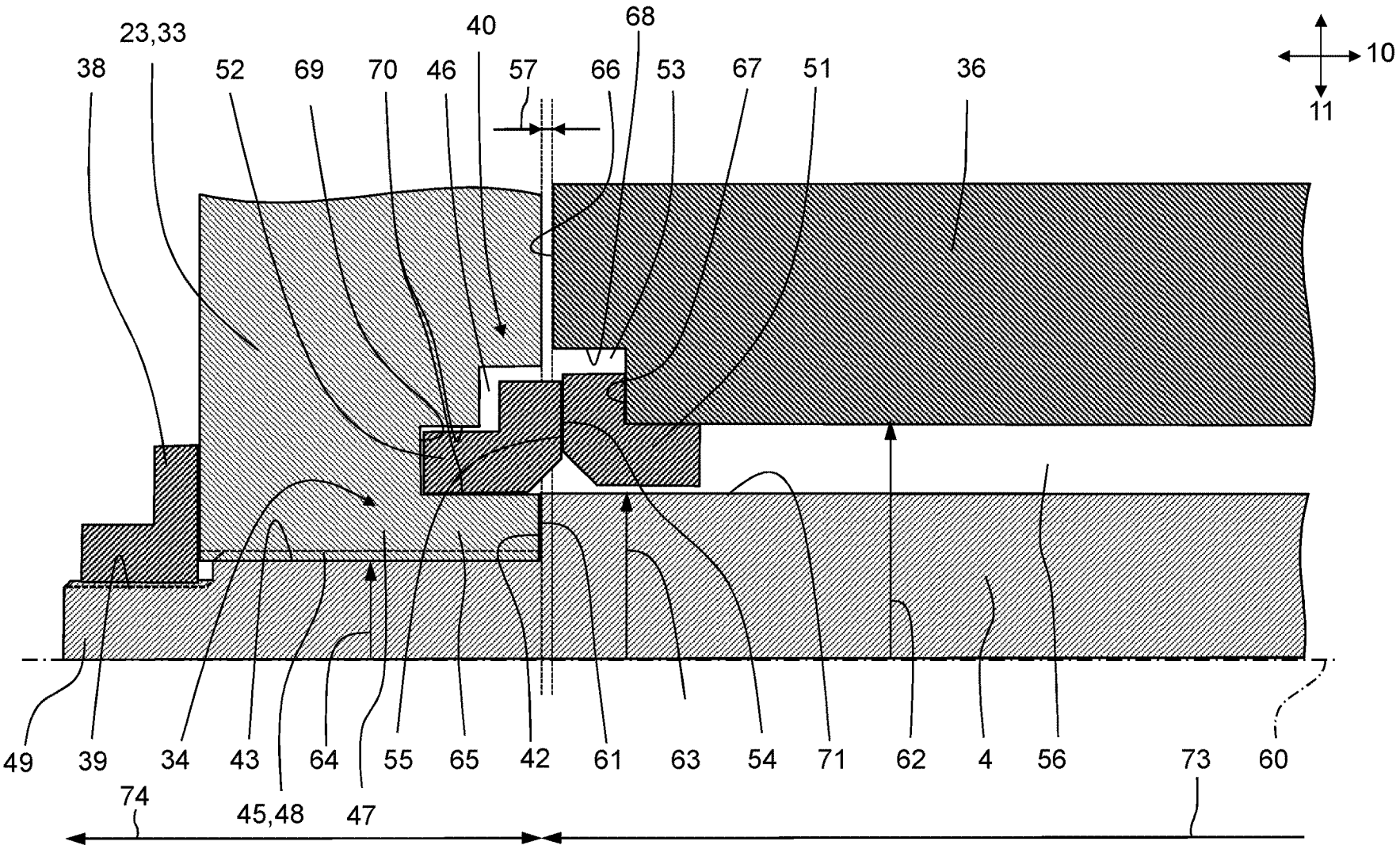
FIG. 7 shows schematically a close-in view of a portion of FIG. 6.

FIG. 7 schematically shows an enlargement of the area 41 marked with dashed rectangle in FIG. 6 for better illustrating the details of the seat 34 of the first shaft 4, the first rotor 23, the sealing arrangement 40 and the first rotor case hub 36, according to an example embodiment of the pump. The dashed-dotted line 60 lines refers to a rotational centre axis of the first shaft 4. The same design applies also to the second rotor 24, the second shaft 5 and the second rotor case hub 37. However, the specific design of the sealing arrangement illustrated and described with reference to FIGS. 6 and 7 merely represent example embodiments of the sealing arrangement and other configurations and implementations of the sealing arrangement are possible within the scope of the disclosure and present claims.

The rotor seat 34 of the first shaft 4 has an axial abutment surface 42 facing in an axial direction 10 towards a front side 17 of the pump 1 and a mounting surface 43 facing radially outwards, i.e. in a direction perpendicular to the axial direction 10. In the assembled state of the pump 1, a mounting portion 47 of each rotor drive element 33 is located in the rotor seat 34 of one of the first and second shafts 4, 5. The mounting portion 47 of each rotor drive element 33 is indicated by a dashed circle in FIG. 6.

The mounting surface 43 of the rotor seat 34 may be provided with splines, a key-connection, a non-cylindrical surface, or the like for rotational engagement with corresponding splines 45 or the like provided on an interior mounting surface 48 of the rotor drive element 33.

A threaded fastener 38, such as a nut, may be engaged with a mating threaded section 39, such as a threaded pin-shaped section, at the end region 49 of the shaft 4 and configured for axially pressing the rotor drive element 33 against the axial abutment surface 42 of the rotor seat 34. This may also be achieved by means of a screw or bolt, possibly accompanied by a disc (similar to a washer), screwed into a threaded axial hole at the end region 49 of the shaft 4.

The first annular sealing part 51 is located in a front seal seat 53 of the first hub 36, and the second annular sealing part 52 is located in the annular rotor seal seat 46 of the rotor drive element 33, which annular rotor seal set 46 is facing towards the rear side 18 of the pump 1. Moreover, a rearward facing sealing surface 54 of the second annular sealing part 52 is axially pressed against a corresponding forward facing sealing surface 55 of the first annular sealing part 51 via a suitable axial pressing arrangement, such as some type of spring or resilient element, in a conventional manner.

As a result, product fluid that has flowed from the interior pumping cavity and having entered a gap 57 between the first rotor case hub 36 and the rotor drive element 33 is prevented from flowing further, and in particular prevented from entering a gap 56 between the interior surface of first rotor case hub 36 and an exterior surface of the first shaft 4, because this could otherwise result in leakage of the product fluid out from the interior pumping cavity.

The location of the sealing arrangement 40 between the rotor 23, 24 and a front region of the associated rotor case hub 36, 37 also enables simplified maintenance because the sealing arrangement 40 is more accessible for maintenance thereof. In particular, access to the sealing arrangement 40 is accomplished by merely removing the removable front cover 26 and thereafter removing the first and/or second rotor 23, 24. Thereafter, the sealing arrangement 40 is fully accessible for cleaning, replacement or maintenance, or the like, all without the need for removing the entire rotor case body 15 from the main body 2. This is also referred to as front loading seals, or front loading sealing arrangement.

Furthermore, the rotary positively displacement pump 1 according to the disclosure, besides enabling reduced maintenance effort by means of the front loading seals, additionally enables improved reliability, improved pumping efficiency, improved cleanability and hygiene without disassembly, also called Clean In Place (CIP), and/or reduced manufacturing cost by means of increased dimension of the first and second shafts 4, 5, all without negative effect on pumping volume or exterior pump dimensions.

This is accomplished by a rotary positive displacement pump 1 for pumping a fluid product according to FIGS. 1-7 of the present disclosure, wherein the pump 1 comprises a main body 2 that provides rotational support to a pair of oppositely rotating, parallel, axially extending, shafts 4, 5 with gears 6, 7 that are in constant mesh condition. The pump 1 further includes a rotor case body 15 connected to a front side 13 of the main body 2. The rotor case body 15 comprises a stationary interior pumping cavity defined by an axial rear wall 20, a circumferential side wall 21 and a removable front cover 26. The rotor case body 15 further comprises a fluid product inlet opening 30, a fluid product outlet opening 31 and a pair of cylindrical rotor case hubs 36, 37 extending from the rear wall 20, wherein each cylindrical rotor case hub 36, 37 receives internally one of the pair of shafts 4, 5.

The rotary positive displacement pump 1 further includes a pair of rotors 23, 24, each having at least one rotor wing 32, preferably a plurality of rotor wings 32, and a rotor drive element 33 that is mounted torque proof on a rotor seat 34 at an end region 49 of one of the pair of shafts 4, 5. The torque proof connection between each of the rotor drive elements 33 and the associated shaft 4, 5 may be a splined or keyed connection. Alternatively, the first and second shaft 4, 5 may have a non-cylindrical shape at said end region 49, such as triangular-shaped, square-shaped, polygon-shaped, oval-shaped, or the like, for enabling the desired torque proof connection between the rotor drive element 33 and the shaft 4, 5.

Moreover, each of the pair of rotor seats 34 has an axial abutment surface 42 facing in an axial direction 10 towards a front side 17 of the pump 1 and a mounting surface 43 facing radially outwards.

Furthermore, the pump 1 comprises a pair of fasteners 38, such as threaded fasteners 38, each being engaged with a mating section 39, such as a mating threaded section 39, at the end region 49 of one of the pair of shafts 4, 5, and each exerting an axial clamping force on one of the rotor drive elements 33 against the axial abutment surface 42 of one of the rotor seats 34, and the axial abutment surface 42 of each rotor seat 34 is located axially outside, towards a front side 17, of the associated hub 36, 37.

A length of the gap 57 between the axial abutment surface 42 of each rotor seat 34 and an axial end surface 66 of the associated hub 36, 37, in the axial direction 10, may for example be about 0.05-5 mm or more, or within a range of about 0.05-50 mm, specifically 0.1-25 mm, more specifically 0.1-10 mm, or even more specifically 0.1-5 mm, or yet more specifically 0.1-1 mm.

Consequently, since the axial abutment surface 42 of each rotor seat 34 is located axially outside, towards a front side 17, of the associated hub 36, 37, the first and second shafts 4, 5 may have a relatively large diameter 63 over a wider range 73, and in particular further towards the front side 17 of the pump 1, thereby enabling increased shaft stiffness without negative effect on pumping volume or exterior pump dimensions.

As mentioned above, increased shaft diameter 63 enables manufacturing of the shafts 4, 5 in less exotic materials without sacrificing operating reliability or risk for material fatigue. Moreover, stiffer shafts 4, 5 generally enables pump design with reduced clearance between the rotor wings 32 and the radial and axial walls 20, 21, 22 of the stationary pumping cavity because stiffer or larger diameter shafts typically result in reduced shaft deflection. Reduced rotor wing clearance may be directly linked with reduced pump slippage and thus increased pumping efficiency. Stiffer shafts 4, 5 also reduces the risk for undesired interference between the first and second rotors 23, 24 during pumping operation.

The rotary positively displacement pump 1 according to the disclosure thus not only enables reduced maintenance effort by means of the front loading seals, the rotary positive displacement pump 1 additionally enables increased dimension of the first and second shafts 4, 5, all without negative effect on pumping volume or exterior pump dimensions.

As a result of having the axial abutment surface 42 of each rotor seat 34 being located axially outside, towards a front side 17, of the associated hub 36, 37, a mounting portion 47 of each rotor drive element 33 is radially non-overlapping the associated cylindrical rotor case hub 36, 37.

The term "mounting portion" herein refers to the portion of the rotor drive element 33 that is radially limited on the inside by the interior mounting surface 48 of the hole or recess 44 of the rotor drive element 33 and on the outside by the annular rotor seal seat 46. Hence, the mounting portion 47 of each rotor drive element 33 does certainly not extend radially outside of an inner diameter 62 of the associated cylindrical rotor case hub 36, 37. By having a mounting portion 47 of each rotor drive element 33 radially non-overlapping the associated cylindrical rotor case hub 36, 37, larger diameter shafts 4, 5 may be used over a wider range within the rotor case body 15, as seen in the axial direction 10.

The mounting portion 47 of each rotor drive element 33 includes an axial abutment surface 61 facing in an axial direction 10 towards a rear side 18 of the pump 1 and a mounting surface 48 facing radially inwards. The axial abutment surface 61 of each mounting portion is located axially outside, towards a front side 17, of the associated hub 36, 37, in particular axially outside of the axial end surface 66 of the associated hub 36, 37. Thereby, larger diameter shafts 4, 5 may be used over a wider range within the rotor case body 15, as seen in the axial direction 10.

In FIG. 7, a large diameter portion 73 of the first shaft 4 is indicated and extends forwards until the axial abutment surface 42 of the rotor seat 34, and a smaller diameter portion 74 of the first shaft is indicated and extends from the axial abutment surface 42 of the rotor seat 34 to a front end of the first shaft 4.

Consequently, an exterior diameter 63 of each shaft 4, 5 in an axial region of the front seal seat 53 of each cylindrical rotor case hub 36, 37, is larger than an exterior diameter 64 of each shaft 4, 5 in an axial region of, and in contact with, the mounting portion 47 of each rotor drive element 33.

The mounting portion 47 of each rotor drive element 33 comprises an annular projection 65 extending towards the rear side 18 of the pump 1, wherein the annular projection 65 comprises the axial abutment surface 61 of the rotor drive element 33, and wherein the annular projection 65 of each rotor drive element 33 is arranged on a portion of the associated shaft 4, 5, namely on the mounting surface 43 of the rotor seat 34.

With reference to FIGS. 6 and 7, the pump 1 may comprise a sealing arrangement 40 in form of a first pair of seal assemblies, such as mechanical face-seal assemblies, i.e. one seal assembly associated with the first rotor case hub 36 and one seal assembly associated with the second rotor case hub 37.

As mentioned above, each seal assembly may include a first part 51 and a second part 52 with sealing surfaces 54, 55 pressed against each other, and each seal assembly may be arranged to prevent fluid product from escaping the stationary pumping cavity and flowing along one of the shafts 4, 5 towards the rear side of the rotor case body 15.

Each cylindrical rotor case hub 36, 37 has a front seal seat 53 facing towards the front side 17 of the pump 1. The front seal seat 53 is located at a front region of each rotor case hub 36, 37, and each front seal seat 53 has the first part 51 of one of the first pair of seal assemblies mounted therein.

More in detail, the front seal seat 53 may correspond to a recess having at least an axial support surface 67 facing towards a front side 17 of the pump 1 for providing an axial support to the first sealing part 51. In addition, the recess of the front seal seat 53 may include a radial support surface 68 facing towards the associated shaft 4, 5, for providing radial support to the first sealing part 51.

As a result of the location of the front seal seat 53 adjacent the axial end surface 66 of the associated hub 36, 37, the first sealing part 51 of each first pair of assemblies faces, as seen in the radial direction, a circumferential outer surface 71 of a portion of the associated shaft 4, 5.

In particular, the first sealing part 51 of each first pair of seal assemblies may even face, as seen in the radial direction, a circumferential outer surface 71 of the large diameter portion 73 of the associated shaft 4, 5.

Each rotor drive element 33 has a rotor seal seat 46 facing towards the rear side 18 of the pump 1, and each rotor seal seat 46 has the second part 52 of one of the first pair of seal assemblies mounted therein.

The rotor seal seat 46, which may be implemented in form of a groove or recess in a rearwards facing surface of the rotor drive element 33 of each rotor 23, 24, may include an axial support surface 69 facing towards a rear side 18 of the pump 1 for providing axial support to the second sealing part 52. In addition, the groove or recess of the rotor seal seat 46 may include at least one radial support surface 70 facing radially inwards and/or outwards for providing radial support to the second sealing part 52.

Figure 8:
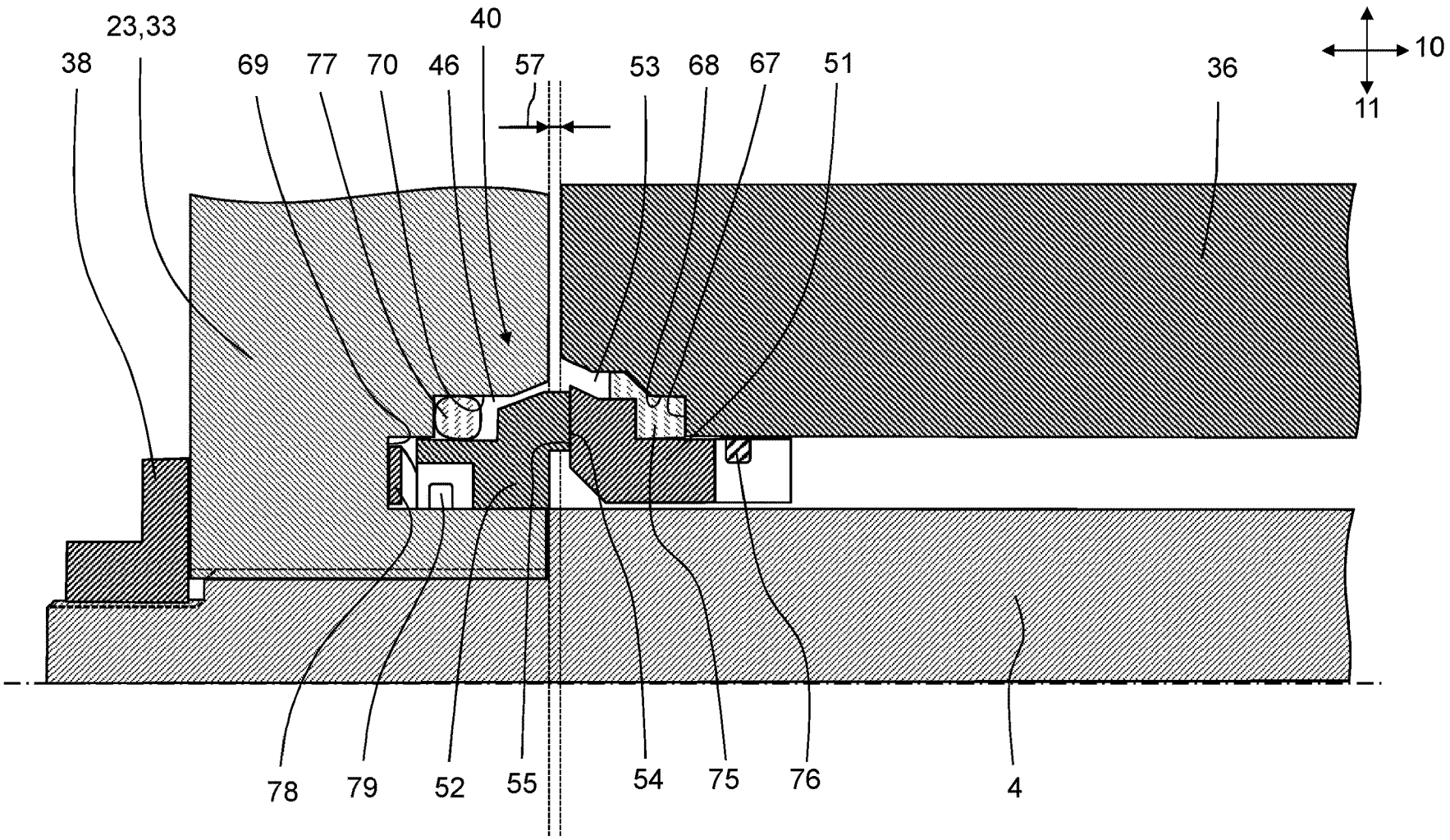
FIG. 8 shows schematically an alternative embodiment of the sealing arrangement.

A further embodiment of the sealing arrangement 40 is schematically illustrated in FIG. 8, wherein some more details of an example implementation are included. For example, the sealing arrangement 40 may include a first elastic sealing ring 75 sandwiched between a rear side of the first sealing part 51 and the axial support surface 67 and/or radial support surface 68 of the front seal seat 53 for improved sealing performance and providing more flexibility in terms of positioning and tolerances of the first sealing part 51. Moreover, the first sealing part 51 may be rotationally fixed relative the first rotor case hub 36 for preventing any relative rotation between the first sealing part 51 and first rotor case hub 36. For example, the rotational connection may be accomplished with a pin 76 or the like connected to the first rotor case hub 36 and configured to interact with the first sealing part 51 for preventing any relative rotation of the first sealing part 51 and first rotor case hub 36.

The sealing arrangement 40 may also include a second elastic sealing ring 77 sandwiched between the second sealing part 52 and the rotor seal seat 46 for improved sealing performance and providing more flexibility in terms of positioning and tolerances of the first sealing part 51. One of the first and second sealing parts 51, 52, for example the second sealing part 52 as illustrated in FIG. 8, may additionally be axially preloaded with an axial spring 78.

Similar to above, also the second sealing part 52 may be rotationally fixed relative the rotor 23, 24 for preventing any relative rotation between the second sealing part 52 and the rotor 23, 24, for example by means of a pin 79 or the like rotationally connected to the rotor 23, 24 and configured to interact with the second sealing part 51 for preventing any relative rotation.

Figure 9:
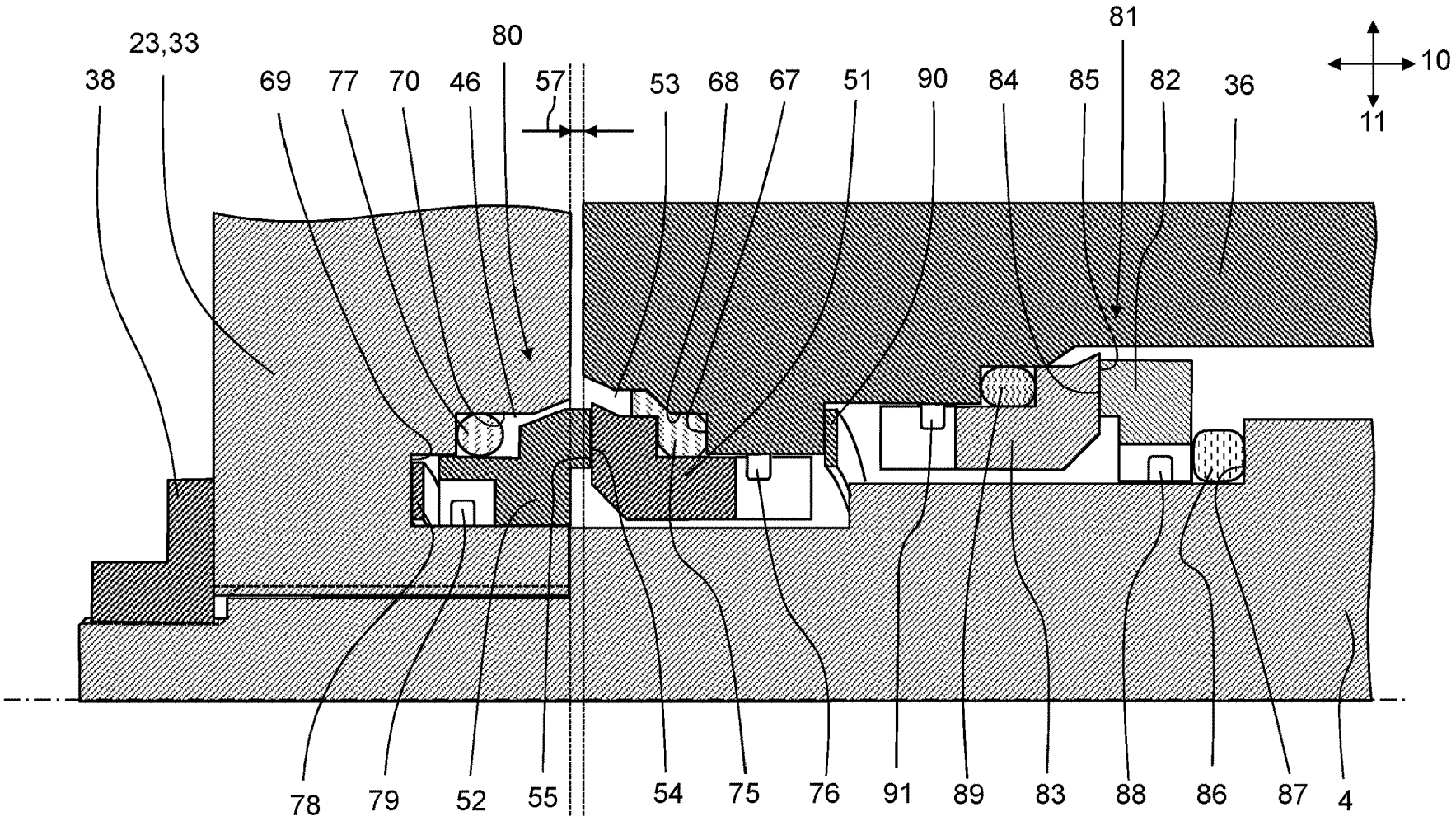
FIG. 9 shows schematically still an alternative embodiment of the sealing arrangement, FIG. 10, 11 show the basic steps of two example embodiments of the methods for assembling a pump according to the disclosure, and FIG. 12 show the basic steps of an example embodiments of a method for providing maintenance of a sealing arrangement of a pump according to the disclosure.

Still a further embodiment of the sealing arrangement 40 is schematically illustrated in FIG. 9, wherein the sealing arrangement 40 further comprises a second pair of seal assemblies, such as mechanical face-seal assemblies. Hence, each rotor case hub 36, 37 is provided with two internal seal assemblies, a first seal assembly 80 located adjacent the front end of the rotor case hub 36, 37, and a second seal assembly 81 arranged further towards the rear side 18 of the pump 1. The first seal assembly in FIG. 9 may have the same configuration as described with reference to FIG. 8.

Each second seal assembly 81 of the second pair of seal assemblies, such as mechanical face-seal assemblies, includes a first sealing part 82 having a first sealing surface 84, and a second sealing part 83 having a second sealing surface 85 pressed against each other, and each second seal assembly 81 is arranged to prevent fluid product from flowing along the shaft towards the rear side of the rotor case body 15.

The second seal assembly 81 may include a first elastic sealing ring 86 sandwiched between a rear side of the first sealing part 82 and an axial support surface 87 of the shaft 4 for improved sealing performance and providing more flexibility in terms of positioning and tolerances of the first sealing part 82. Moreover, the first sealing part 82 may be rotationally fixed relative the shaft 4 for preventing any relative rotation between the first sealing part 82 and first shaft 4. For example, the rotational connection may be accomplished with a pin 88 or the like connected to the first shaft 4 and configured to interact with the first sealing part 82 for preventing any relative rotation there between.

The second seal assembly 81 may also include a second elastic sealing ring 89 sandwiched between the second sealing part 83 and the first rotor case hub 36 for improved sealing performance and providing more flexibility in terms of positioning and tolerances of the second sealing part 83. One of the first and second sealing parts 82, 83, for example the second sealing part 83 as illustrated in FIG. 9, may additionally be axially preloaded with an axial spring 90.

Similar to above, also the second sealing part 83 may be rotationally fixed relative the first rotor case hub 36 for preventing any relative rotation there between, for example by means of a pin 91 or the like connected to the first rotor case hub 36.

However, the second pair of seal assemblies may be implemented using other types of seals. For example, an elastic seal, such as an o-ring or lip seal, may be associated with the rotor case or rotor case hub thereof and a sleeve may be associated with the shaft. Optionally, the elastic seal may be mounted on a housing associated with the rotor case or rotor case hub thereof.

The pump shown in the drawings is a circumferential piston pump.

Figure 10:
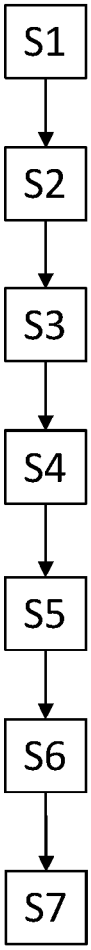

The disclosure also relates to a method of assembling a rotary positive displacement pump for pumping a fluid product as described above. With reference to FIG. 10, the method comprises a first step S1 of providing a main body 2 giving rotational support 3 to a pair of parallel, axially extending, shafts 4, 5 with gears 6, 7 in constant mesh condition, such that the pair of shafts 4, 5 are arranged to rotate in opposite directions. The method further comprises a second step S2 of providing a rotor case body having a stationary interior pumping cavity defined by an axial rear wall, a circumferential side wall, and a removable front cover, a fluid product inlet opening, a fluid product outlet opening, and a pair of cylindrical rotor case hubs extending from the rear wall, wherein the rotor case body 15 is located on a front side 13 of the main body 2, and wherein each cylindrical rotor case hub 36, 37 receives internally one of the pair of shafts 4, 5. In addition, the method comprises a third step S3 of providing a pair of rotors, each having at least one rotor wing, preferably a plurality of rotor wings, and a rotor drive element. Moreover, the method comprises a fourth step S4 of mounting each rotor drive element torque proof on a rotor seat at an end region of one of the pair of shafts, wherein each rotor seat has an axial abutment surface facing in an axial direction towards a front side of the pump and mounting surface facing radially outwards. Finally, the method comprises a fifth step S5 of mounting a fastener 38, such as a threaded fastener 38, on an end region of each of the pair of shafts 4, 5, a sixth step S6 of tightening the pair of fasteners for exerting an axial clamping force on each rotor drive element against the axial abutment surface of one of the rotor seats, wherein the axial abutment surface of each rotor seat is located axially outside, towards a front side, of the associated hub, and a seventh step S7 of mounting the removable front cover on the rotor case body.

Clearly, the consecutive order of at least some of the steps may change without in significant change of effect, such as for example in particular the first, second and third steps.

In addition to above, the method may further comprise an intermediate step, performed before mounting the rotor drive elements to the shafts, of mounting a first part of a first pair of seal assemblies, such as mechanical face-seal assemblies, in a front seal seat of each cylindrical rotor case hub, and mounting a second part of the first pair of seal assemblies, such as mechanical face-seal assemblies, in a rotor seal seat of each rotor drive element.

Here again the consecutive order of at least some of the steps may change without a significant change of effect. For example, the step of mounting the second part 52 of the first pair of seal assemblies in the rotor seal seat of each rotor drive element 33 may be performed any time after having provided the rotor.

Figure 11:
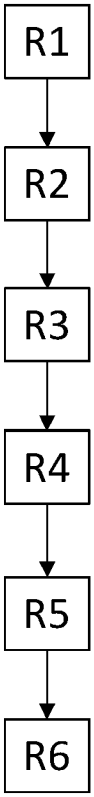

The disclosure also relates to another method of assembling a rotary positive displacement pump, such as a circumferential piston pump or rotary lobe pump, for pumping a fluid product as described above. With reference to FIG. 11, the method comprises a first step R1 of providing a pump having two parallel axially extending shafts, an interior pumping cavity and a pair of cylindrical rotor case hubs extending towards the front side from a rear wall of the interior pumping cavity. The method further comprises a second step R2 providing a pair of rotors, each having at least one wing, preferably a plurality of wings, connected to a central rotor drive element, and a third step R3 of mounting a first part of a first pair of seal assemblies, such as mechanical face-seal assemblies, in a front seal seat of each cylindrical rotor case hub, and mounting a second part of the first pair of seal assemblies, such as mechanical face-seal assemblies, in a rotor seal seat of each rotor drive element. The wing(s) may in case of a lobe pump be denoted lobe(s). The method additionally comprises a fourth step R4 of mounting one of the pair of rotors on each shaft, wherein each shaft has a rotor seat with an axial abutment surface facing in an axial direction towards a front side of the pump. Finally, the method comprises a fifth step R5 of abutting each rotor drive element against the axial abutment surface of an associated rotor seat, wherein the axial abutment surface of each rotor seat is located axially outside, towards a front side, of the associated hub, and a sixth step R6 mounting a removable front cover on the pump.

Figure 12:
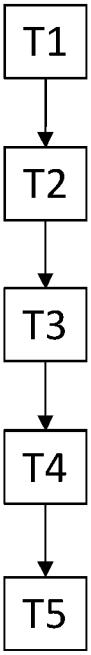

In addition to above, the disclosure also relates to a method of providing maintenance to a sealing arrangement 40 of a rotary positive displacement pump 1 as described above. With reference to FIGS. 1-7, the rotary positive displacement pump 1 has a front side 17 and a rear side 18, two parallel axially extending shafts 4, 5 each carrying a rotor 23, 24 having at least one rotor wing 32, preferably a plurality of rotor wings 32, and a rotor drive element 33. The rotary displacement pump 2 further has an interior pumping cavity including a pair of cylindrical rotor case hubs 36, 37 extending towards the front side 17 from a rear wall of the interior pumping cavity, wherein each shaft 4, 5 has a rotor seat 34 with an axial abutment surface 42 facing in an axial direction towards a front side 17 of the pump 1. With reference to FIG. 12, the method comprises a first step T1 of removing a removable front cover 26 of the pump 1, and a second step T2 of removing at least one of the pair of rotors 23, 24 from the associated shaft 4, 5 for enabling access to a sealing arrangement 40 configured for preventing leakage along a gap 56 between the associated shaft 4, 5 and the associated cylindrical rotor case hub 36, 37. The method comprises a third step T3 of servicing the sealing arrangement 40, and a subsequent fourth step T4 mounting the at least one removed rotor 23, 24 on the associated shaft 4, 5 and abutting the rotor drive element 33 against the axial abutment surface of an associated rotor seat 34, wherein the axial abutment surface of each rotor seat 34 is located axially outside, towards a front side 17, of the associated hub 36, 37. Finally, the method comprises a fifth step T5 of mounting the removable front cover 26 on the pump 1.

Clearly, the method of providing maintenance to a sealing arrangement 40 of the rotary positive displacement pump 1 may include steps of removing both the first and second rotors 23, 24 from the associated shafts 4, 5, servicing of the sealing arrangements 40 associated with both the first and second rotors 23, 24, and subsequent remounting of both the first and second previously removed rotors 23, 24 on the associated first and second shafts 4, 5 while abutting each rotor drive element 33 against the axial abutment surface of the associated rotor seat 34, wherein the axial abutment surface of each rotor seat 34 is located axially outside, towards a front side 17, of the associated hub 36, 37. Many additional alternative sequences for performing the maintenance steps of the pump are possible, such as removing the first rotor, servicing its sealing arrangement and mounting of the first rotor, and subsequently performing the corresponding steps of the second rotor and its sealing arrangement 40, or still other sequences resulting from other mixing of the steps/actions of the method.

The term "enabling access to a sealing arrangement 40" herein refers to the fact that a sealing arrangement 40 is arranged in a front region of each of the cylindrical rotor case hub 36, 37 and thereby is easily accessible by service personnel from a front side of the pump 1 upon removal of the first and second rotors 23, 24, thereby eliminating the need to dismount the rotor case body 15 or rotor case rear housing 25, such that simplified servicing and maintenance of the pump is accomplished.

Furthermore, the term "servicing" of the sealing arrangement 40 herein refers to actions such as inspection, measurement, cleaning and/or replacement of the sealing arrangement 40 and/or associated seal seats, such as the front seal seat 56 and/or rotor seal seat 46. For example, the step T3 of servicing the sealing arrangement 40 may include removing a second part 52 of a seal assembly, such as a mechanical face-seal assembly, of the sealing arrangement 40 from a rotor seal seat 46 of the at least one removed rotor 23, 24, removing a first part 51 of the seal assembly, such as the mechanical face-seal assembly, from a front seal seat 53 of the associated cylindrical rotor case hub 36, 37, mounting a new second part 52 of a new seal assembly, such as a new mechanical face-seal assembly, in the rotor seal seat 46 of the at least one removed rotor 23, 24, mounting a new first part 51 of the new seal assembly, such as the new mechanical face-seal assembly, in the front seal seat 53 of the associated cylindrical rotor case hub 36, 37.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, modifications may be made to adapt a particular situation or material to the teachings of the present disclosure without departing from the essential scope thereof.

Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims. Reference signs mentioned in the claims should not be seen as limiting the extent of the matter protected by the claims, and their sole function is to make claims easier to understand.

The invention claimed is:

1. A rotary positive displacement pump for pumping a fluid product, the pump having a pump front side and a pump rear side and comprising:

a main body providing rotational support to a pair of parallel, axially extending, shafts with gears in constant mesh condition, such that the pair of shafts are arranged to rotate in opposite directions, a rotor case body connected to a front side of the main body and having:

a stationary interior pumping cavity defined by an axial rear wall, a circumferential side wall, and a removable front cover, a fluid product inlet opening, a fluid product outlet opening, and a pair of cylindrical rotor case hubs extending from the rear wall, wherein each cylindrical rotor case hub receives internally one of the pair of shafts, a pair of rotors, each having at least one rotor wing and a rotor drive element that is mounted torque proof on a rotor seat at an end region of one of the pair of shafts, wherein each of the pair of rotor seats has an axial abutment surface facing in an axial direction towards a front side of the pump and a mounting surface facing radially outwards, wherein the pump further comprises a pair of fasteners, each being engaged with a mating section at the end region of one of the pair of shafts, and each exerting an axial clamping force on one of the rotor drive elements against the axial abutment surface of one of the rotor seats, and wherein the axial abutment surface of each rotor seat is located axially outside, towards the pumper front side, of the associated hub.

2. The rotary positive displacement pump according to claim 1, wherein a mounting portion of each rotor drive element is radially non-overlapping the associated cylindrical rotor case hub.

3. The rotary positive displacement pump according to claim 1, wherein a mounting portion of each rotor drive element includes an axial abutment surface facing in an axial direction towards a rear side of the pump and a mounting surface facing radially inwards, and wherein the axial abutment surface of each mounting portion is located axially outside, towards the pump front side, of the associated hub.

4. The rotary positive displacement pump according to claim 2, wherein the mounting portion of each rotor drive element does not extend radially outside of an inner diameter of the associated cylindrical rotor case hub.

5. The rotary positive displacement pump according to claim 3, wherein each rotor drive element comprises an annular projection extending towards the rear side of the pump, wherein the annular projection comprises the axial abutment surface, and wherein each annular projection is arranged on a portion of the associated shaft.

6. The rotary positive displacement pump according to claim 1, further comprising a first pair of seal assemblies, each having a first part and a second part with sealing surfaces pressed against each other, and each arranged to prevent fluid product from escaping the stationary pumping cavity and flowing along one of the shafts towards the rear side of the rotor case body.

7. The rotary positive displacement pump according to claim 6, wherein each cylindrical rotor case hub has a front seal seat facing towards the pump front side of the pump, wherein the front seal seat is located at a front region of each rotor case hub, and wherein each front seal seat has the first part of one of the first pair of seal assemblies mounted therein.

8. The rotary positive displacement pump according to claim 6, wherein the first part of each first pair of seal assemblies faces, as seen in the radial direction, a circumferential outer surface of a portion of the associated shaft.

9. The rotary positive displacement pump according to claim 6, wherein each rotor drive element has a rotor seal seat facing towards the rear side of the pump, wherein each rotor seal seat has the second part of one of the first pair of seal assemblies mounted therein.

10. The rotary positive displacement pump according to claim 6, wherein the rotary positive displacement pump is configured for front-loading of the first pair of seal assemblies.

11. The rotary positive displacement pump according to claim 7, wherein an exterior diameter of each shaft in an axial region of the front seal seat of each cylindrical rotor case hub, is larger than an exterior diameter of each shaft in an axial region of, and in contact with, a mounting portion of each rotor drive element.

12. The rotary positive displacement pump according to claim 6, further comprising a second pair of seal assemblies, each having a first part and a second part with sealing surfaces pressed against each other, and each arranged to prevent fluid product from flowing along the shaft towards the rear side of the rotor case body.

13. Method for assembling a rotary positive displacement pump for pumping a fluid product, the pump having a pump front side and a pump rear side, the method comprising:

providing a main body giving rotational support to a pair of parallel, axially extending, shafts with gears in constant mesh condition, such that the pair of shafts are arranged to rotate in opposite directions, providing a rotor case body having:

a stationary interior pumping cavity defined by an axial rear wall, a circumferential side wall, and a removable front cover, a fluid product inlet opening, a fluid product outlet opening, and a pair of cylindrical rotor case hubs extending from the rear wall, wherein the rotor case body is located on a front side of the main body, and wherein each cylindrical rotor case hub receives internally one of the pair of shafts, providing a pair of rotors, each having at least one rotor wing and a rotor drive element, mounting each rotor drive element torque proof on a rotor seat at an end region of one of the pair of shafts, wherein each rotor seat has an axial abutment surface facing in an axial direction towards the pump front side of the pump and a mounting surface facing radially outwards, mounting a fastener on an end region of each of the pair of shafts, tightening the pair of fasteners for exerting an axial clamping force on each rotor drive element against the axial abutment surface of one of the rotor seats, wherein the axial abutment surface of each rotor seat is located axially outside, towards the pump front side, of the associated hub, and mounting the removable front cover on the rotor case body.

14. Method according to claim 13, further comprising an intermediate step, performed before mounting the rotor drive elements to the shafts, of mounting a first part of a first pair of seal assemblies in a front seal seat of each cylindrical rotor case hub, and mounting a second part of the first pair of seal assemblies in a rotor seal seat of each rotor drive element.

15. Method for providing maintenance to a sealing arrangement of a rotary positive displacement pump having a pump front side and a pump rear side, two parallel axially extending shafts each carrying a rotor having at least one rotor wing and a rotor drive element, and an interior pumping cavity including a pair of cylindrical rotor case hubs each extending towards the pump front side from a rear wall of the interior pumping cavity, wherein each shaft has a rotor seat with an axial abutment surface facing in an axial direction towards the pump front side, the method comprising:

removing a removable front cover of the pump, removing at least one of the pair of rotors from the associated shaft for enabling access to the sealing arrangement configured for preventing leakage along a gap between the associated shaft and the associated cylindrical rotor case hub, servicing the sealing arrangement, mounting the at least one removed rotor on the associated shaft and abutting the rotor drive element against the axial abutment surface of an associated rotor seat, wherein the axial abutment surface of each rotor seat is located axially outside, towards the pump front side, of the associated hub, and mounting the removable front cover on the pump.

* * * * *